US009721712B2

(12) United States Patent
Provencher

(10) Patent No.: US 9,721,712 B2
(45) Date of Patent: Aug. 1, 2017

(54) HYBRID MECHANICAL AND MAGNETIC FASTENING SYSTEM

(71) Applicant: Samuel David Provencher, Waltham, MA (US)

(72) Inventor: Samuel David Provencher, Waltham, MA (US)

(73) Assignee: Boston Inventions, LLC, Waltham, MA (US)

( * ) Notice: Subject to any disclaimer, the term of this patent is extended or adjusted under 35 U.S.C. 154(b) by 0 days.

(21) Appl. No.: 15/060,014

(22) Filed: Mar. 3, 2016

(65) Prior Publication Data

US 2016/0307680 A1 Oct. 20, 2016

Related U.S. Application Data

(60) Provisional application No. 62/147,372, filed on Mar. 3, 2015.

(51) Int. Cl.

| | |
|---|---|
| ***H01F 7/02*** | (2006.01) |
| ***A45C 13/10*** | (2006.01) |
| ***A41F 1/00*** | (2006.01) |

(52) U.S. Cl.

CPC ..... *H01F 7/0263* (2013.01); *A41F 1/002* (2013.01); *A45C 13/1069* (2013.01)

(58) Field of Classification Search

CPC ..... H01F 7/0263; A45C 13/1069; A41F 1/002
See application file for complete search history.

(56) References Cited

U.S. PATENT DOCUMENTS

| | | | | | |
|---|---|---|---|---|---|
| 2,389,298 | A * | 11/1945 | Ellis | A41F 1/002 | 101/389.1 |
| 2,389,299 | A * | 11/1945 | Ellis | A41F 1/002 | 2/96 |
| 3,102,314 | A * | 9/1963 | Alderfer | A41F 1/002 | 24/303 |
| 3,869,764 | A * | 3/1975 | Umezu | A44B 18/0053 | 24/585.1 |
| 4,197,618 | A * | 4/1980 | Bourguignon | A41F 1/002 | 24/303 |
| 4,249,267 | A * | 2/1981 | Voss | A41F 1/002 | 2/121 |
| 4,941,236 | A * | 7/1990 | Sherman | A44C 5/2071 | 24/265 WS |
| 6,301,754 | B1 * | 10/2001 | Grunberger | A41F 1/002 | 24/303 |
| 7,065,841 | B2 * | 6/2006 | Sjoquist | A41F 1/002 | 24/303 |
| 8,997,318 | B2 * | 4/2015 | Nicolas | A44C 5/04 | 24/265 WS |
| 2009/0289090 | A1 * | 11/2009 | Fullerton | A45F 5/02 | 224/183 |

* cited by examiner

*Primary Examiner* — Mohamad Musleh
(74) *Attorney, Agent, or Firm* — Ascentage Patent Law, LLC; Travis Lee Johnson; David S. Einfeldt

(57) ABSTRACT

The present disclosure relates to a hybrid fastener system involving combining mechanical tensile features with magnetic components.

20 Claims, 11 Drawing Sheets

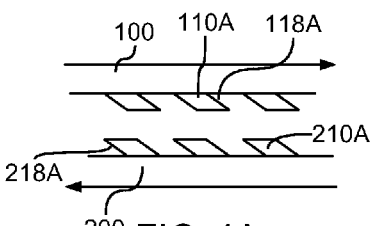
FIG. 4A
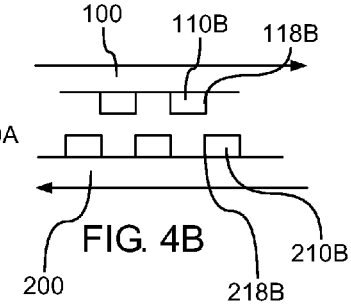
FIG. 4B
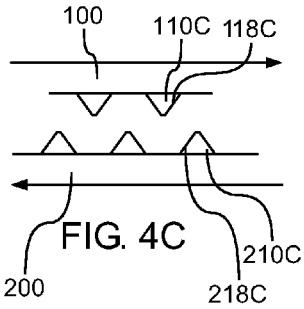
FIG. 4C
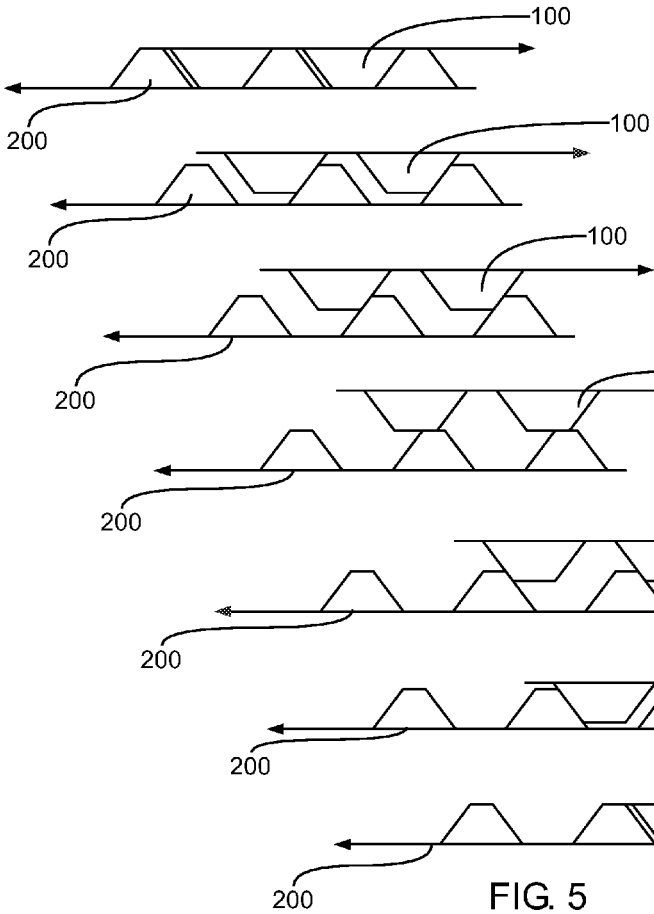
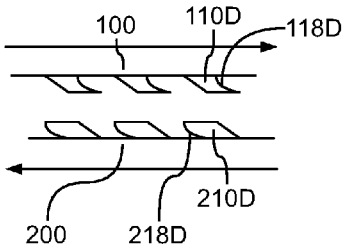
FIG. 4D
FIG. 5

HYBRID MECHANICAL AND MAGNETIC FASTENING SYSTEM

PRIORITY CLAIM

This application claims the benefit of provisional patent application No. 62/127,372 which was filed on Mar. 3, 2015, which is incorporated by reference in its entirety.

COPYRIGHT STATEMENT

A portion of the disclosure of this patent application document contains material that is subject to copyright protection including the drawings. The copyright owner has no objection to the facsimile reproduction by anyone of the patent document or the patent disclosure as it appears in the Patent and Trademark Office file or records, but otherwise reserves all copyright rights whatsoever.

BACKGROUND OF THE INVENTION

1. Field of the Invention

The disclosure relates to clasps, straps, buttons, snaps, and other removable fastening systems designed for repetitive use which are often used in clothing or other applications involving fastening of one thing to another.

2. Description of the Prior Art

Present systems involve the use of hook and loop type fasteners, snaps, buttons or other mechanical methods for fastening two independent components together. Such systems typically rely on a simple interference fit, friction fit, or other engagement to provide the fastening of the two independent components. For example, a first button component relies on the improbability of proper orientation of the button through the second eye component, alternatively a hook and loop system relies on the elastic deformation of a plurality of first hook components being engaged with a plurality of second loop components, gaining strength and stability in numbers. These types of two component fastening systems have varying degrees of stability, strength, and reliability. Hook and loop fasteners in particular can be noisy to release and can also be uncomfortable in certain orientations of the various components while simple magnetic pairings which exist in pre-existing systems have thus far proven to have insufficient strength in situations involving high tension.

The present invention seeks to overcome many deficiencies present in the prior art by providing a hybrid fastening system which has both mechanical and magnetic components operating in tandem to ensure a quick easy but also secure coupling between a first and second component. It will be appreciated that the embodiments shown include the use of first and second components as they relate to the closure of a wrist portion of a glove, however, as will be appreciated by those having skill in the art, that the present embodiment can be used to replace, hook and loop, button, snap, buckles or any number of fasteners in any number of implementations from clothing, to locking container lids, in commercial and household applications.

SUMMARY

Contemplated herein is one or more embodiments of a hybrid mechanical and magnetic fastening system. The system can include a first fastener component having one or more primary mechanical features, the one or more primary mechanical features having a primary interference surface, the first fastener component also having a first magnetic component as well as a second fastener component having one or more secondary mechanical features, the one or more secondary mechanical features having a secondary interference surface coinciding in shape with the primary interference surface of the first fastener component so as to be interferingly engageable, the second fastener component having a second magnetic component. The system can further include a primary contact plane being defined as a primary plane between the first and second fastener, wherein the first and second magnetic components are configured to attract to one another and cause engagement of the primary and secondary interference surfaces.

In some embodiments an alignment guide can be provided on one of the first or second fastener components as well as a guide channel provided on the other of the opposing first or second fastener components the guide channel being configured to receive the alignment guide.

In yet additional embodiments the first and second magnetic components can be provided as the guide channel and the alignment guide.

In yet further embodiments the mechanical features of both the first and second fastener components can be provided having a multi-axial trapezoidal shape being trapezoidal in shape in respective planes being parallel to the first and second engagement surfaces.

It will be further appreciated that in some instances the first magnetic component can be embedded above the one or more mechanical features of the first fastener component. Additionally, the second magnetic component can be embedded below the one or more mechanical features of the second fastener component.

In yet additional embodiments the primary interference surface can be formed by an out-of-plane ramped surface with respect to the primary contact plane. Alternatively, the primary and secondary interference surfaces can be formed into corresponding and interfering acute interference surfaces which result in a plurality of hooks. Or further, the primary interference surface can be formed as an orthogonal surface with respect to the primary contact plane.

Yet additional embodiments can be provided with a plurality of primary and mechanical features and a plurality of secondary mechanical features wherein each being mechanical feature can be spaced at respective corresponding intervals about the first and second fastener components.

In yet further embodiments a release tab can be provided or otherwise formed about the first or second fastener components, wherein the release tab configured to receive a tensile force and thus release engagement between the first and second fastener component.

While several embodiments have been described herein that are exemplary of the present invention, one skilled in the art will recognize additional embodiments within the spirit and scope of the invention. Modification and variation can be made to the disclosed embodiments without departing from the scope of the disclosure. Those skilled in the art will appreciate that the applications of the embodiments disclosed herein are varied. Accordingly, additions and modifications can be made without departing from the principles of the disclosure. In this regard, it is intended that such changes would still fall within the scope of the disclosure. Therefore, this disclosure is not limited to particular embodiments, but is intended to cover modifications within the spirit and scope of the disclosure. This being a brief description of the various embodiments, it will be understood that additional embodiments and potential features will be discussed herein below in the detailed description.

BRIEF DESCRIPTION OF THE DRAWINGS

FIGS. 4A-D illustrate side conceptual views of various engagement surface options for use in the various hybrid mechanical and magnetic fastening systems contemplated herein in accordance with various aspects of the present invention;

FIG. 5 illustrates side conceptual views of various self-adjustment capabilities and steps of an exemplary hybrid mechanical and magnetic fastening system in accordance with various aspects of the present invention;

DETAILED DESCRIPTION

To provide an overall understanding of the systems, devices, and methods described herein, certain illustrative embodiments will be described. Although the embodiments and features described herein are frequently described for use in clothing applications, it will be understood that all the components, mechanisms, systems, methods, and other features outlined below can be combined with one another in any suitable manner and can be adapted and applied to other similar systems and in any number of suitable settings.

The present application seeks to provide a solution to the aforementioned problems, namely to provide an adjustable, strong, and comfortable clasp which can be easily coupled or released through the use of a single opposing hand. This is achieved by providing a clasp which utilizes both magnetic and mechanical interfaces to secure or otherwise couple opposing components one to one another. The mechanism can include a large number of engagement points which will increase coupling strength and also utilize magnets so as to reduce potential points of failure, thus increasing the number of use cycles the clasp can withstand. It will be appreciated that in some cases, the use of clips or springs can be a reasonable substitute for magnets without requiring significant modifications to the designs.

The mechanical and magnetic hybrid clasp system is a compact clasp design which utilizes out of plane and interfering opposing surfaces which engage and disengage using only one hand. The execution of both engaging and releasing the mechanical and magnetic hybrid clasp system as described herein is configured to be easy-to-use, intuitive and while reducing the amount of physical strength required to use the simple. However, when the clasp is engaged, because of the locking mechanisms involved, the resulting coupling can be stronger than presently available buttons or clasps because the mechanical and magnetic hybrid clasp system involves the combination of tensile interference with magnetic assurance of component alignment which increases the tensile strength of the resulting coupling along desired directions.

Figure 1A:
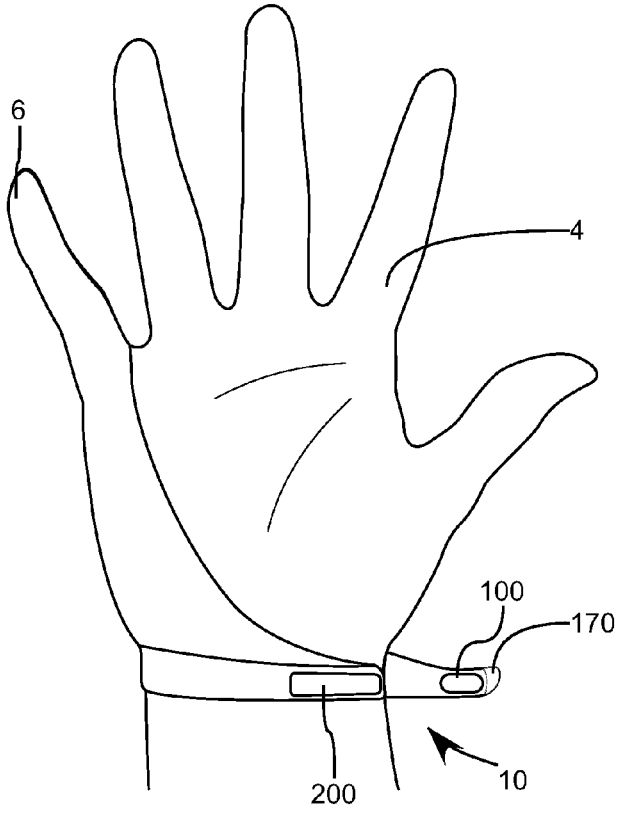
FIGS. 1A-B illustrate front and rear views of a glove implementing a magnetic mechanical hybrid clasp in accordance with one embodiment of the present invention.
Figure 1B:
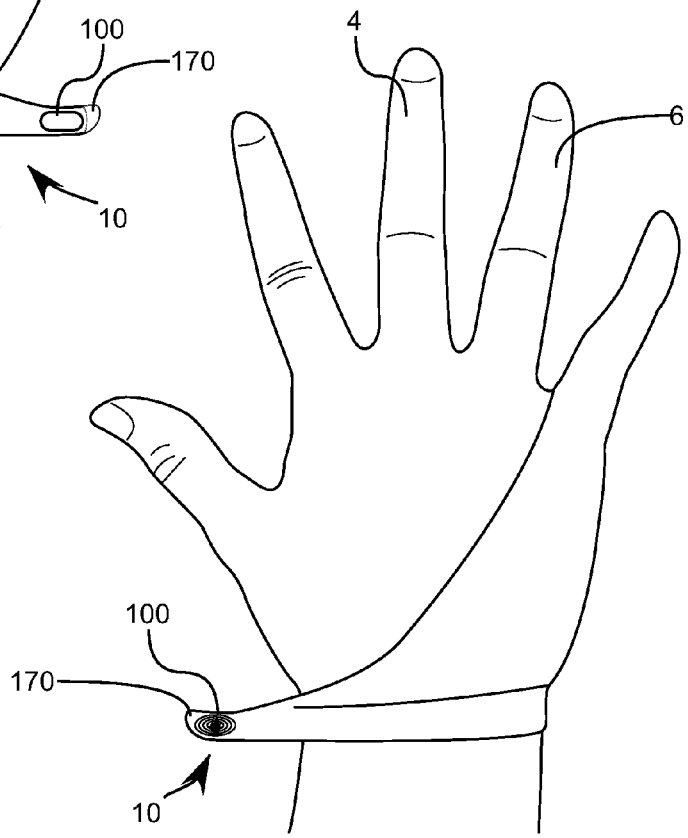

FIGS. 1A-B illustrate a potential use of a hybrid mechanical and magnetic clasping or fastening system 10 as applied to a wrist portion of a glove 6 on a user's hand 4. It will be appreciated that similar systems could be used to provide secure closure around the neck portion of a coat or shirt, as a latch for a box lid, bags, as well as in certain jewelry or accessory applications, and will be of particular use in one-handed applications as well as in applications requiring numerous and successive clasping and unclasping.

In the present disclosure, the glove and wrist closure will be discussed in detail, but it will be appreciated that this discussion is only for exemplary purposes with the understanding that those of ordinary skill in the art will be capable of applying the fastening system in virtually unlimited applications.

It will be further appreciated that for such closures typically include at least two components, i.e. a first fastener component 100 and a second fastener component 200 which the user desires to fasten together. As shown in FIGS. 1A-B as well as in FIG. 2 each of the fastener components can have magnetic components embedded therein, 114 and 214, respectively which attract the two components together, thus forming a hybrid mechanical and magnetic fastening system 10 as contemplated herein. The magnetic components 114 and 214 can be configured to draw or attract one another into proper position with respect to one another so as to form a solid coupling therebetween. Additionally, the hybrid mechanical and magnetic fastening system 10 can include one or more mechanical features 110 and 210 provided on their respective first and second fastener components. In some of the embodiments shown, the drawing together of the magnetic components are provided to facilitate proper positioning, while the mechanical components are configured to bear the majority of the coupling or clasping shear load.

A tab grip 170, which can have a tacky or other tactile coating, can be provided on a distal end about one of the connection components so as to aid in the separation of the fastener components (100, 200) as desired. In other embodiments, and as will be discussed below, the distal end of a strap portion can function as part of a locking mechanism so as to prevent unintended release of the coupling between the first and second fastener components, 100 and 200 respectively.

Figure 2:
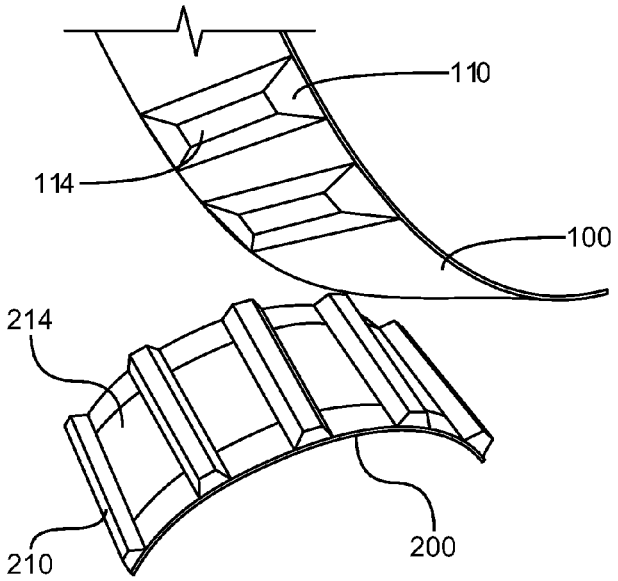
FIG. 2 illustrates a perspective view of an exemplary hybrid mechanical and magnetic fastening system in accordance with various aspects of the present invention.

FIGS. 2-3 illustrate an embodiment wherein the primary mechanical features 110, i.e. the mechanical features provided on the first fastening component 100, include a primary interference surface 118, wherein the secondary mechanical features 210, i.e. mechanical features provided on the second fastening component 200, which also includes a corresponding secondary interference surface 218 coinciding in shape with the primary interference surface 118 of the first fastener component 100 so as to be interferingly engageable therewith.

A primary contact plane can be defined as a primary plane between the first and second fastener and parallel with the major axis of both the first and second fastening components. It will thus be understood that the first and second magnetic components are configured to attract to one another and aid in the engagement of the primary and secondary interference surfaces. The interference surfaces, when engaged, bear a tensile load between the first and second fastener components. This tensile load runs primarily in-plane along the primary contact plane. It should be noted, and discussed below, that the primary contact plane can vary along the fastener components when the embodiments are configured to have curvature, or flexibility. This curvature or flexing ability allows the fastener components to conform around, for instance, the wrist of a hand.

In essence, the first component 100 and the second component 200 of the mechanical and magnetic fastening system 10 include mechanical features that mesh together or otherwise engage with the help of magnetic features. The magnetic features can aid in the initial engagement of the mechanical features and can also ensure that the mechanical features remain engaged unless a proper decoupling force is applied. It will be understood that once the first and second components come within close proximity to each other, the magnetic components will cause them to naturally gravitate towards one another, and come into proper alignment one with another. This alignment can be the direct result of magnetic components, but can also be aided by using one or more mechanical alignment features discussed below.

Figure 3A:
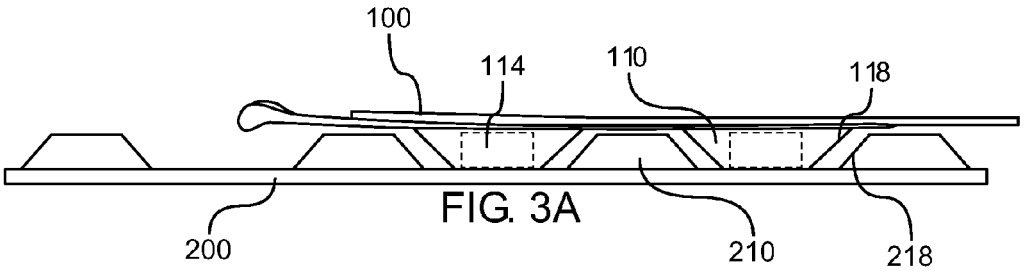
FIGS. 3A-B illustrate side cross-sectional views of various engagement steps of an exemplary hybrid mechanical and magnetic fastening system in accordance with various aspects of the present invention.
Figure 3B:
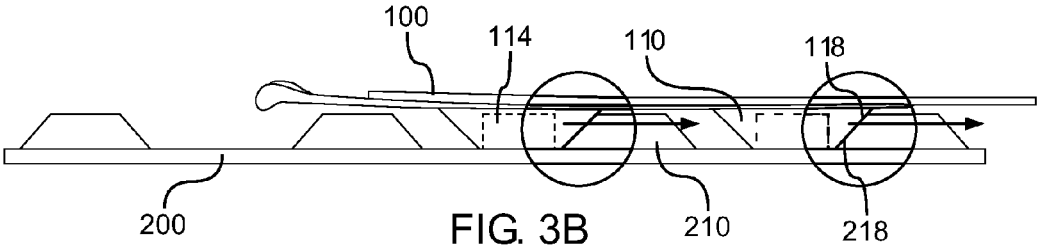

FIGS. 3A-B illustrate a second fastening component 200 provided with a larger number of mechanical features along its length, while the first fastening component 100 has fewer. In some variations the first fastening component can be provided with a single mechanical feature having a single interference surface 118. As a result, the first fastening component 100 can be adjusted to engage anywhere along the length of the secondary mechanical features of the second fastening component, thus giving a range of acceptable engagement points and offering a certain degree of customizability or adjustment.

The mechanical features of both opposing fastening components (100, 200) can be spaced to allow for a certain amount of tolerance and float between them. As shown, FIG. 3A illustrates a more central or even placement between the first and second fastening components. Meanwhile, FIG. 3B illustrates how under a shear load, i.e. tensile load of the wrist closure, that the mechanical features, as well as the magnetic components, allow the two fastening components to slide until the mechanical components are engaged. As such, the hybrid mechanical and magnetic fastening system 10 can be designed to allow for a significant amount of float in the active engagement range between the relative placement of the first component with respect to the second component 200. The range of float can be described as a spacing distance between the back non-engagement surfaces when the interference surfaces are contacting one another. However, by increasing the strength of attraction between the respective magnetic components, i.e. using stronger magnets, the magnetic force could also pull the first and second mechanical components into proper alignment even when resting on top of one another.

FIGS. 4A-B illustrate various potential configurations of mechanical features which allow for differing tensile strengths between the opposing fastening components. In particular, FIG. 4A illustrates a plurality of mechanical features 110A and 210A each having a reverse inclined or acute angle interference surfaces 118A and 218A respectively, having an acute angle with respect to the primary contact plane, or strap, forming a plurality of hook-like structures, or in other words having a concave or partially enclosed area. This arrangement provides increased mechanical coupling strength, and can withstand a larger shear force because the tensile force will actually cause the first and second fastening components to draw more tightly together. This arrangement can have tighter engagement tolerances and can also be configured so as to be more difficult to disengage, because of the geometry of the mechanical features.

Alternatively, FIG. 4B illustrates a plurality of mechanical features 110B and 210B each having orthogonal interference surfaces 118B and 218B respectively, being orthogonal or having a right angle with respect to the primary contact plane, or strap. This arrangement provides a balance between and ease of engagement and disengagement.

FIG. 4C illustrates another embodiment where a plurality of mechanical features 110C and 210C each having ramped interference surfaces 118C and 218C respectively, where the ramp or inclined surfaces form an obtuse angle with respect to the primary contact plane, or strap. This arrangement provides the easiest engagement and disengagement with the lowest tensile strength.

FIG. 4D illustrates another embodiment where a plurality of mechanical features 110D and 210D each having contoured, concave, or hooked interference surfaces 118D and 218D respectively, where the contoured, concave, or hooked surfaces form an cavity having a relative acute angle with respect to the primary contact plane, or strap. It will be appreciated that these contoured surfaces can have increasingly complex contours and shapes with corresponding mating features on opposing corresponding surfaces. This arrangement can have tighter engagement tolerances and can also be configured so as to be more difficult to disengage, because of the geometry of the mechanical features.

It will be appreciated that in the various embodiments discussed in FIGS. 4A-D the corresponding portion of shear force carried by the mechanical features versus the magnetic normal force and friction can be varied significantly based on the specific orientation and respective aggressiveness of the mechanical features. It will be appreciated that the acute angle or concave embodiments will be capable of bearing a higher percentage of the shear force, meanwhile the obtuse ramped, or orthogonal features will be capable of bearing relatively less of the same amount of shear force.

Figure 6:
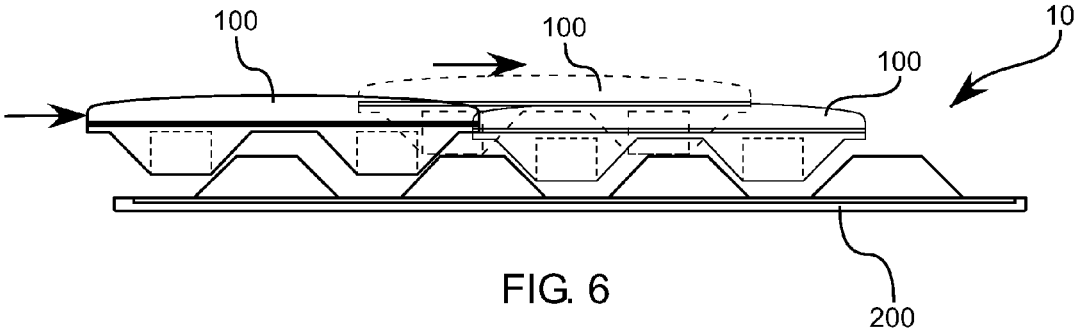
FIG. 6 illustrates a side cross-sectional view of various self-adjustment capabilities and steps of an alternative exemplary hybrid mechanical and magnetic fastening system in accordance with various aspects of the present invention.

FIGS. 5-6, illustrate embodiments of the mechanical and magnetic fastening system 10, where the ramped and orthogonal interference surfaces, are configured to auto adjust in response to a tensile force. Using a waist belt or a wrist closure for illustrative purposes, the strap with auto-adjusting features will typically only need to have sufficient tensile strength to hold up one's pants or maintain the glove on the hand, but not cut off circulation or prevent high tensile forces from releasing the fastening system. In this manner the ramped interference surfaces can allow the components to slide with respect to one another and even pop or translate down to the next engagement position given a certain tensile force, which will be understood to be dependent on the frictional properties as well as the angle of the ramp. Both frictional and ramping angles can be modified based on the desired application. Once the tensile force has overcome the friction and ramp angle, the first and second components will slide until re-aligned with the next coupling position, where the magnet will then again draw them together. In this manner the fastening system can automatically loosen, but not necessarily to the point where full release is caused, or at least until no more alignment positions remain.

Figure 20:
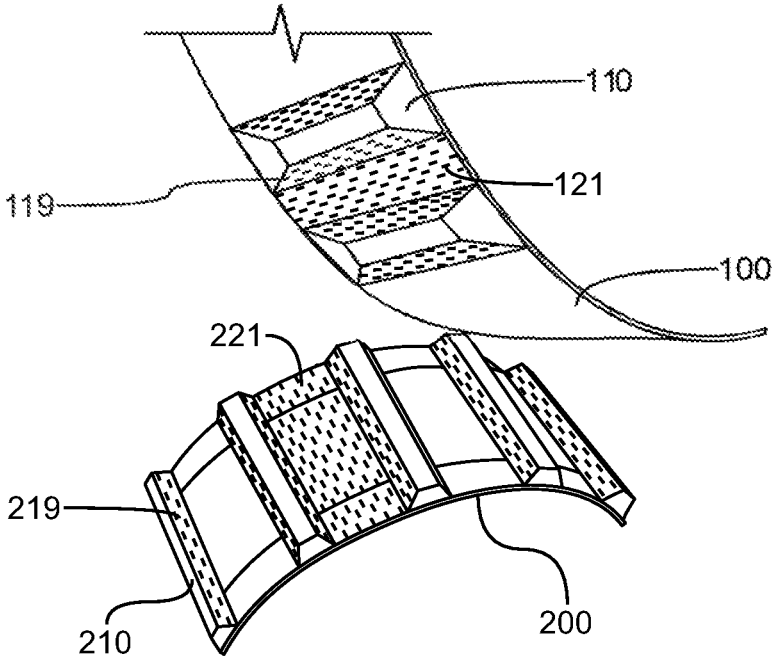
FIG. 20 illustrates a perspective view of an embodiment of a pair of first and second fastening components having additional friction material provided thereto.

As illustrated in FIG. 20, the contact surfaces of the various embodiments can be provided with varying coefficients of friction between the opposing contact surfaces so as to customize the amount of tensile forces the various components can withstand. As illustrated the first fastening component 100 can be provided with various friction components 119 on the mechanical features 110 with corresponding secondary friction components 219 being provided on the mechanical features 210 of the second fastening component 200. It will be appreciated that the respective texturing components can be provided as an overlay or overmolding, such as providing an additional silicone layer over the mechanical features. Alternatively, an adhesive strip having one or more friction components can be provided on the respective contact surfaces or each individual friction component can be adhered to the contact surface. In yet additional embodiments the actual surfaces can be machined or otherwise mechanically roughened. Or a series of protrusions and corresponding indentations can be provided on a first and second contact surface so as to allow the friction components to mesh together and provide additional sliding interference. Those having skill in the art will further recognize various additional potential methods for providing additional friction between the various contact surfaces.

In addition to the mechanical features, the opposing surfaces forming the primary contact plane can also be provided with friction components 121 and 221 respectively so as to cause friction between the respective tips and bottoms of the respective mechanically interfering components.

It will also be appreciated that the interfering surfaces can be formed of varying materials having varying inherent coefficients of friction, such as metals, silicone, plastics, polymers, etc. Alternatively, the varying components can be formed of a desired material, and overmolded, overlaid, or otherwise provided with an intermediate friction material provided thereon using various methods as will be appreciated by those having skill in the art. In some embodiments the friction components can be independently attached and removable for customization by the end user. Additionally it will be appreciated that the magnetic components can be provided having varying magnetic forces so as to alter the normal force which interacts in conjunction with the varying coefficient of friction.

In the particular case of the glove application as shown in FIG. 1, there exists a situation where perfect precision on the part of the user may not be possible because, as will be readily ascertained, the use of only a single hand to engage the clasp causes a significant reduction in precision for most users, or similarly, the use of a non-dominant hand will also cause a significant reduction in precision.

Figure 7A:
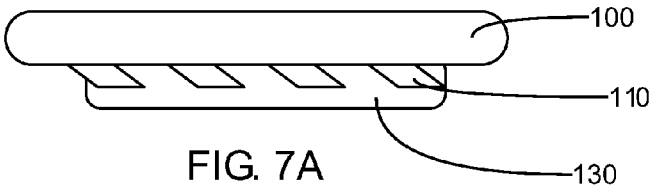
FIGS. 7A-B illustrate side top and cross sectional end views of various guiding features provided on a first fastening component each feature being adaptable for use in the various hybrid mechanical and magnetic fastening systems contemplated herein and in accordance with various aspects of the present invention.
Figure 7B:
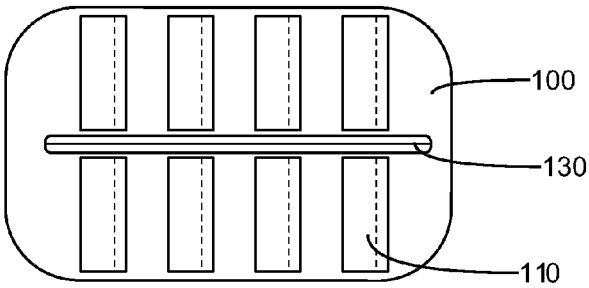
Figure 7C:
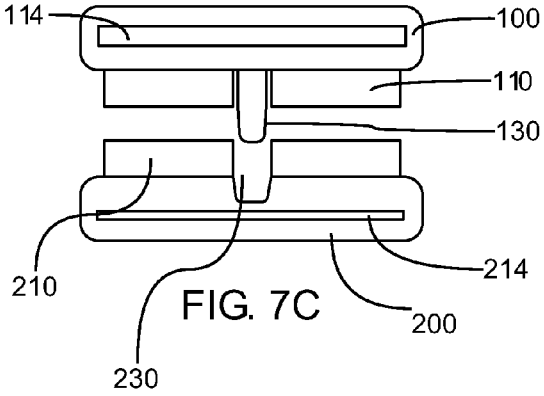
FIG. 7C illustrates and end cross-sectional view of an exemplary hybrid mechanical and magnetic fastening system utilizing various guiding features adaptable for use in the various hybrid mechanical and magnetic fastening systems contemplated herein and in accordance with various aspects of the present invention.

FIGS. 7A-C (first fastener component) and 8 (second fastener component) illustrate an additional embodiment which utilizes an alignment guide 130 provided on the first fastener components as well as a guide channel 230 provided on the second or the opposing fastener component. The guide channel 230 being configured to receive the alignment guide 130.

Figure 8:
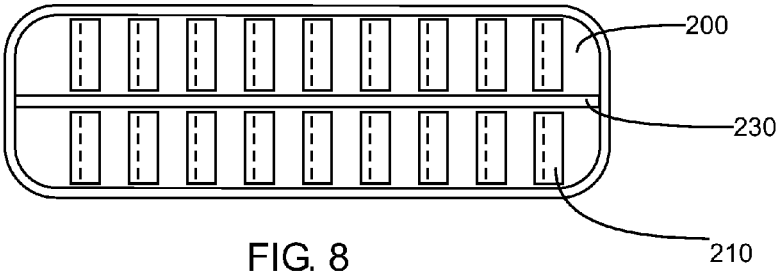
FIG. 8 illustrates a top view of a receiver or a second fastening component having various guiding features adaptable for use in the various hybrid mechanical and magnetic fastening systems in accordance with various aspects of the present invention.

The second component 200 illustrated in FIG. 8 having mechanical features in the form of receiver blades 210 as well as a guide channel 230 for receiving the center guide of the first component (not shown here but illustrated in FIGS. 7A-C). The second component 200 can also be provided with a magnet, or magnetically reactive component embedded therein so as to attract itself to the magnetic portion in the first component or clasp portion.

The alignment guide 130 can be configured to be received in the guide channel 230 so as to limit decoupling of the first and second fastening components 100 and 200 by lateral translation, i.e. side to side, along the length of the mechanical components until they are no longer engaged with each other.

Figure 9A:
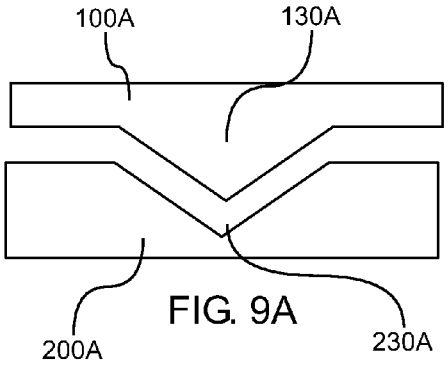
FIGS. 9A-B illustrate end cross-sectional views various shaped guide channels adaptable for use in the various hybrid mechanical and magnetic fastening systems in accordance with various aspects of the present invention.
Figure 9B:
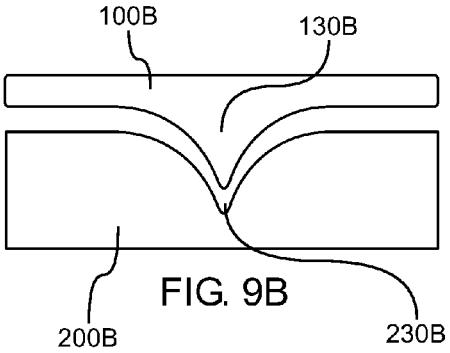
Figure 10A:
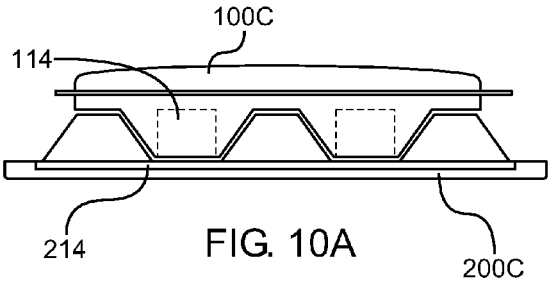
FIGS. 10A-B illustrate side and end cross-sectional views of yet another an exemplary hybrid mechanical and magnetic fastening system in accordance with various aspects of the present invention.
Figure 10B:
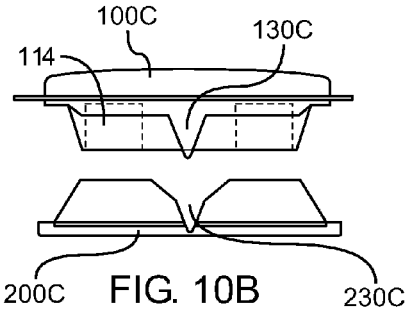

It will be appreciated that the alignment guide 130 and corresponding channel 230 can have various shapes and configurations, as shown in FIGS. 9A-B and 10A-B, having either an angled alignment guide 130A and corresponding guide channel 230A or a graduated alignment guide 130B-C and corresponding guide channels 230B-C. In particular, the graduated alignment guide shown in FIG. 8B can have a graduation with a changing relative curvature matching a Fibonacci ratio as shown in FIG. 9B, one or more ramped surfaces having varying angles as shown in FIGS. FIGS. 9A and 10A-B, or a circular function. This graduated angle for the various guide channels allows a certain range of relative placement relative to the first and second fastening components in an axial direction which will still result in proper alignment and eventual engagement of the corresponding mechanical components.

As shown in FIGS. 7A, 7C, 10B, 11, 12B, and FIGS. 16A-C, it is of particular advantage for the alignment guide 130 to extend beyond the lower surface of the mechanical features 110 so as to facilitate guiding when the mechanical features are not fully engaged, particularly such as when auto-adjusting is enabled as discussed above with respect to FIGS. 5-6.

In some embodiments certain advantages can be recognized by embedding the various magnetic components either above the one or more mechanical features of the first fastener component and/or below the one or more mechanical features of the second fastener component. In yet other alternative embodiments the alignment guide and the guide channel can be formed to operate as the first and second magnetic components themselves, wherein magnetic components are not embedded therein, but rather the components are formed from attracting magnets.

Figure 11:
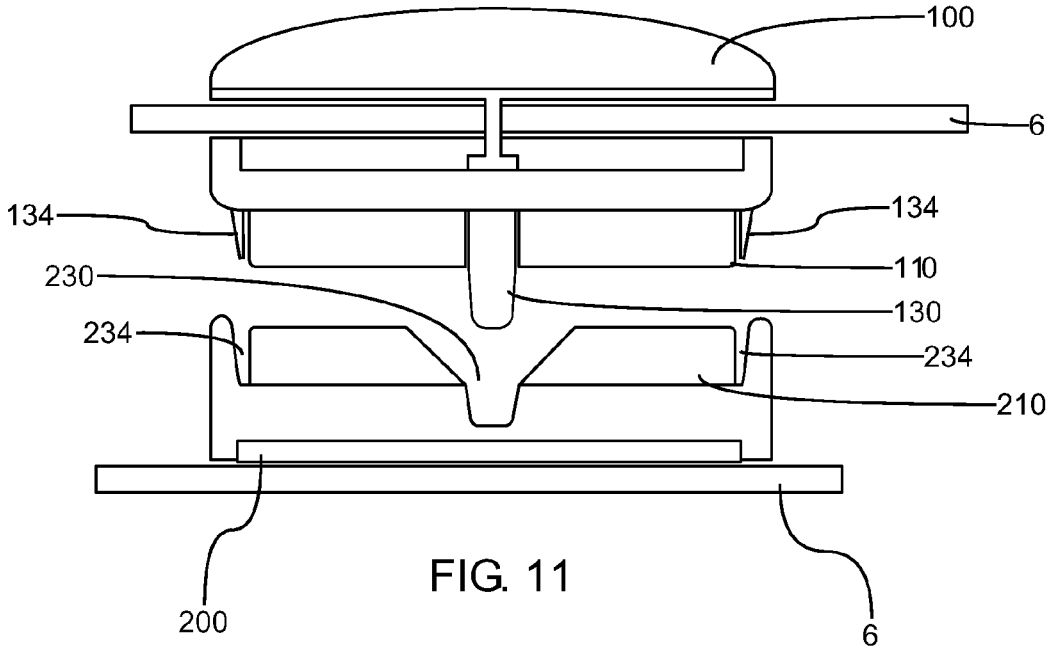
FIG. 11 illustrates an end cross-sectional view of yet another an exemplary hybrid mechanical and magnetic fastening system in accordance with various aspects of the present invention.

It will be appreciated that while the alignment guides are shown in many embodiments as being centrally located, as shown in FIG. 11, multiple and or single alternative alignment guides 134 with corresponding channels 234 can be located at edge portions of the fastening system. It will be appreciated that these edge located alignment guides can be used in conjunction with, or even completely replace, the centrally located alignment guide 130 and guide channel 230. It will be further appreciated that the edge located alignment guides and channels can have any of the shape characteristics as discussed above.

Figure 12A:
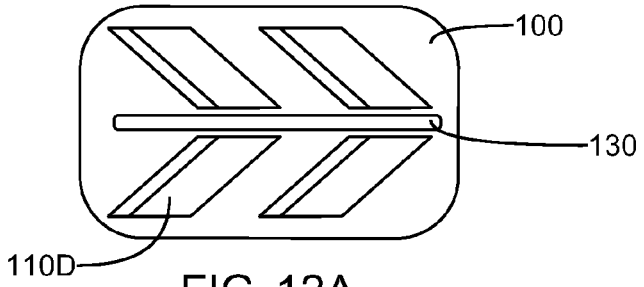
FIGS. 12A-B illustrate top, and side views of yet another an exemplary first fastening component adaptable for use with the various embodiments being in accordance with various aspects of the present invention.
Figure 12B:
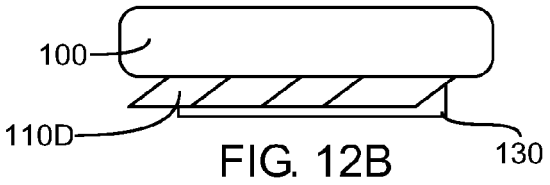
Figure 12C:
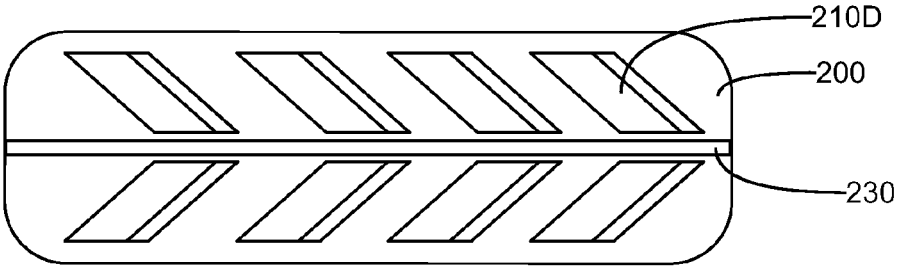
FIG. 12C illustrates a top view of yet another exemplary second fastening component adaptable for use in one or more of the hybrid mechanical and magnetic fastening systems contemplated herein and in accordance with various aspects of the present invention.
Figure 13A:
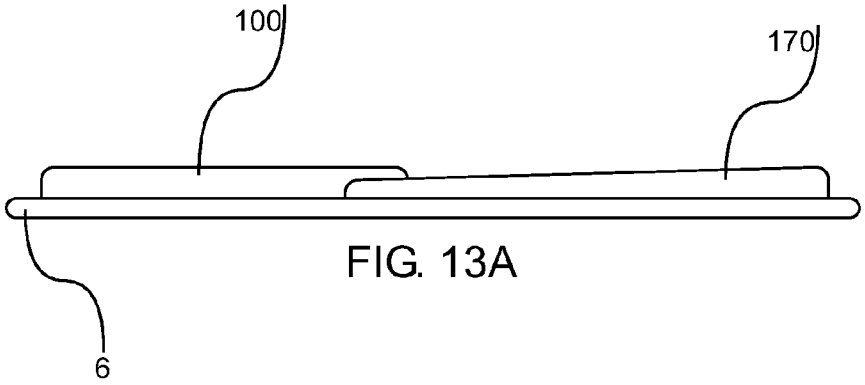
FIGS. 13A-B illustrate side and top views of a first fastening component having an exemplary release tab for use in one or more of the embodiments of the various hybrid mechanical and magnetic fastening systems contemplated herein and being in accordance with various aspects of the present invention.
Figure 13B:
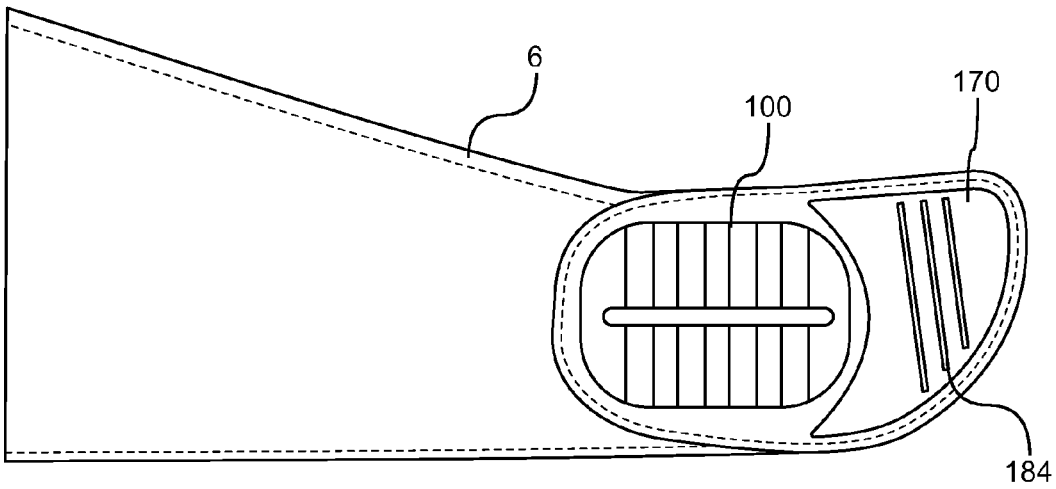
Figure 14A:
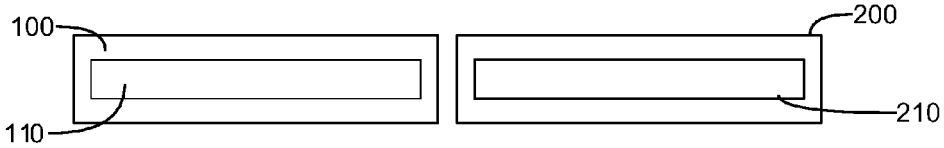
FIGS. 14A-F illustrate various top views of potential alignment possibilities between first and second fastening components in various embodiments contemplated herein.
Figure 14B:
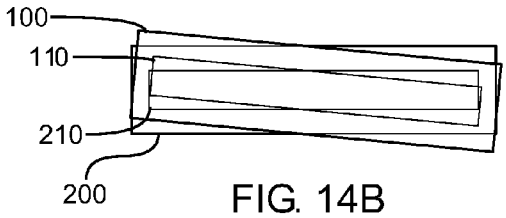
Figure 14C:
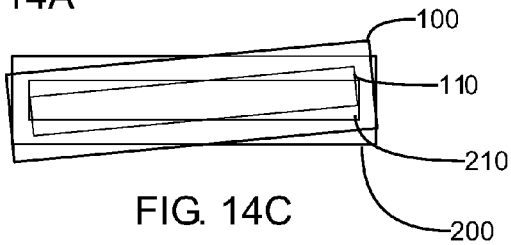
Figure 14D:
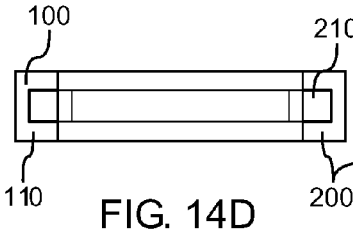
Figure 14E:
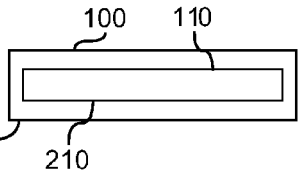
Figure 14F:
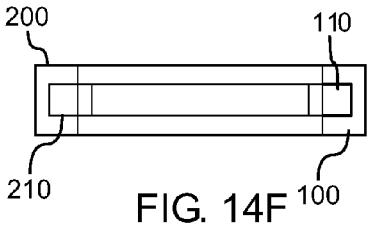

In yet additional embodiments, and as shown in FIGS. 12A-C the mechanical features of both the first and second fastener components can be provided having a trapezoidal cross section, the cross-section being taken in a plan being parallel to the primary contact plane. This trapezoidal shape will tend to draw the first and second fastening components to a centrally oriented position when pulled, thus further aiding in proper alignment. This arrangement can be combined with an axial trapezoidal cross-section so as to form a multi-axial trapezoidal shape, which shape can greatly increase the coupling strength between the first and second fastening components.

FIGS. 13A-B, 17, 18, and 19 illustrate how the fastening system 10 can further include various release tabs formed about the first or second fastener components configured to receive a force and thus release engagement between the first and second fastener component.

It will be appreciated that the release tab 170 can be formed at a distal free end which extends from the first fastening component 100. The release tab can include a tactile or grip enhancing texturing or surface 184 so as to aid the user in grasping the release tab 170. By pulling the release tab an out of plane force can be exerted on the first fastening component 100 which can then be peeled away by exerting sufficient force so as to overcome the elastic properties of the mechanical components, where applicable, as well as the magnetic attraction force between the magnetic components. It will be further appreciated that the release tab 170 can aid in providing a grasping area for purposes of placement during initial alignment for fastening the components not just during release. The release tab can be provided with a panel which allows it to be stitched as part of the tab itself or adhered or stitched separately. It can be provided as a raised grip area that has thickness and ridges to make it easy to feel for the when the user has a proper grip on the tab. In addition the release tab can be stitched about the entire circumference, wherein the first component of the fastening system can effectively sandwich the tab grip between the base fabric layer and the first component thus giving it a robust construction and providing a certain degree of leverage to the first component for coupling and decoupling actions. In this manner, the tab grip can be provided with even more reinforcement by further providing a solid pin, possibly metal, which holds the tab grip or the entire first component assembly together.

Figure 17A:
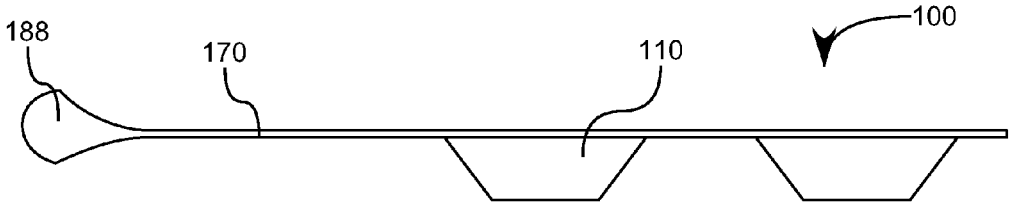
FIGS. 17A-B illustrate side and perspective views of a first fastening component having an additional exemplary release tab for use in one or more of the embodiments of the various hybrid mechanical and magnetic fastening systems contemplated herein and being in accordance with various aspects of the present invention.
Figure 17B:
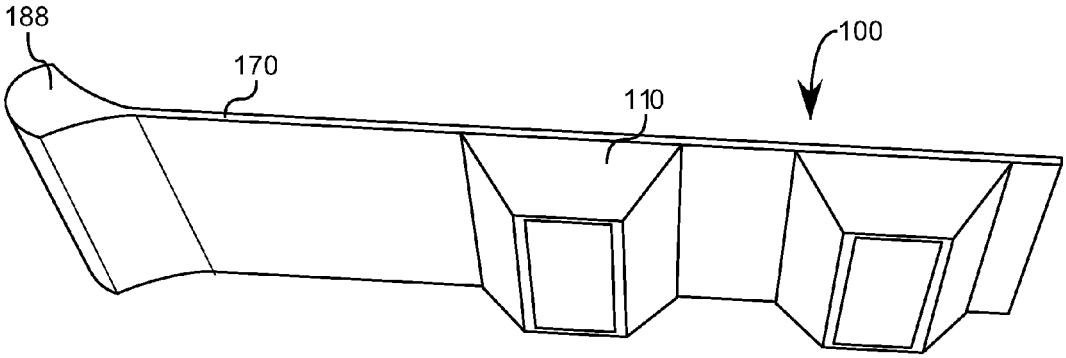
Figure 18:
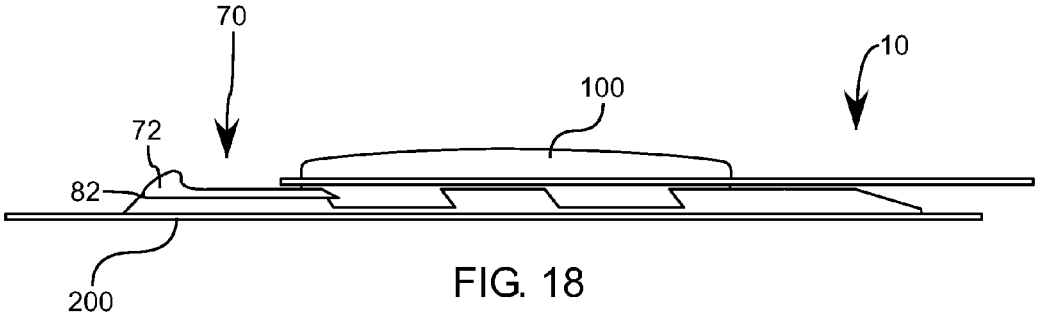
FIG. 18 illustrates a side cross-sectional view of a hybrid mechanical and magnetic fastening system including a locking tab component adaptable for use in the various embodiments discussed herein.
Figure 19:
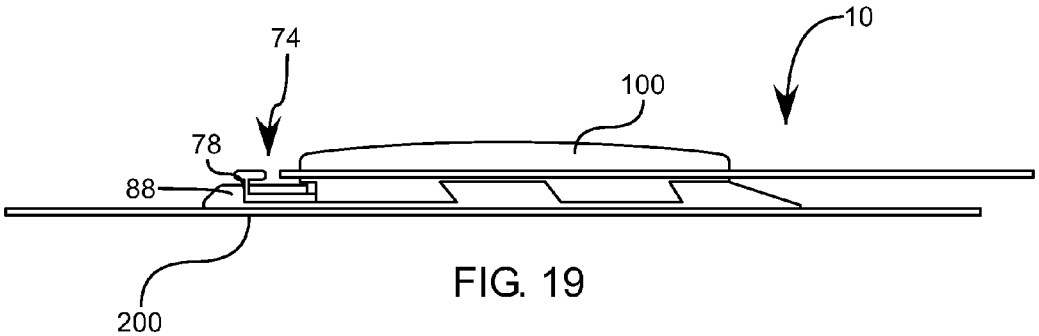
FIG. 19 illustrates a side cross-sectional view of another embodiment of a hybrid mechanical and magnetic fastening system including a locking tab component adaptable for use in the various embodiments discussed herein.

In some alternative embodiments, as shown in FIG. 17, the release tab can include a flared portion 188 so as to aid the user in gripping the tab rather than a separately provided gripping surface. Additionally, as shown in FIGS. 18 and 19 B illustrate various locking mechanisms 70 and 74 adaptable for use in the various embodiments, but of particular advantage when used in the aggressive style blade configuration. The locking mechanisms 70 and 74 can have a downwardly biased locking tab, 72 and 78 respectively, being provided on the respective first components 100 which engage a lip, 82 and 88 respectively, provided on the second component 200. The difference being that in FIG. 18 the locking mechanism 70 is released by sliding the locking tab 72 in a lateral direction. Alternatively, the locking mechanism 74 of FIG. 19 is released by pushing downward on the locking lip 88, or a button provided thereon, or alternatively by pulling upward on the locking tab 78.

FIGS. 14 A-F illustrate how the respective first and second fastening components can provide a certain degree of rotational axial float by increasing the spacing of the mechanical components, wherein the float provides additional flexibility, and thus comfort of use, to the user. Additional float while maintaining fastening strength can be achieved by increasing the width of the respective guide channels or reducing the thickness of the respective alignment guides. In particular FIG. 14A illustrates a top view of an exemplary first fastener component 100 and corresponding protrusion 110 as well as an exemplary second fastener component 200 and inter-protrusion channel for receiving the protrusion 110 separate from one another. FIG. 14B illustrates an engaged, yet slightly clockwise rotated first fastener 100 component with respect to the second fastener component 200. FIG. 14C illustrates an engaged, yet slightly counter-clockwise rotated first fastener 100 component with respect to the second fastener component 200. FIG. 14D illustrates an engaged, yet slightly left oriented first fastener 100 component with respect to the second fastener component 200. FIG. 14E illustrates an engaged, and centered first fastener 100 component with respect to the second fastener component 200. Finally, FIG. 14B illustrates an engaged, yet slightly right aligned first fastener 100 component with respect to the second fastener component 200. It will be appreciated that because the inter protrusion channel on the second fastener component 200 is slightly oversized, that the components can be fully engaged, yet still allow for some in-plane float to allow for some flexibility between the components.

Figure 15:
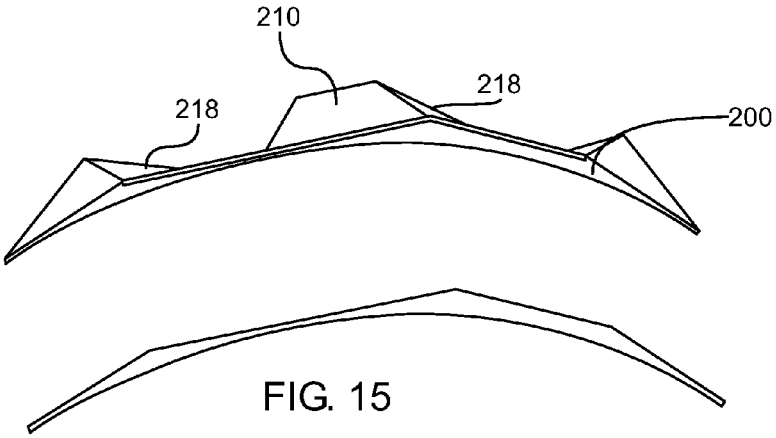
FIG. 15 illustrates a side view of a second fastening component demonstrating curvature or flexibility.

FIG. 15 illustrates how the primary contact plane can be defined on a flexible surface wherein the mechanical components also allow for a corresponding degree of flexure, and thus can be bent in an arc; for example, around the curvature of a wrist or neck. It will then be appreciated that, even though the fastening component is bent into an arcuate shape, the contact surfaces can still extend from the local contact plane so as to provide out-of-plane interference surfaces which allows for the necessary mechanical coupling as discussed above.

Figure 16A:
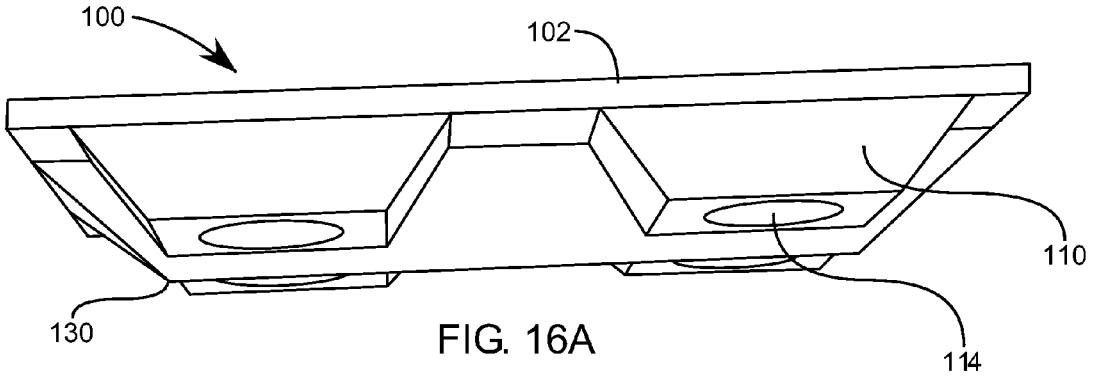
FIGS. 16A-C illustrate various perspective views of yet another exemplary first fastening components for use with the various hybrid mechanical and magnetic fastening systems in accordance with various aspects of the present invention.
Figure 16B:
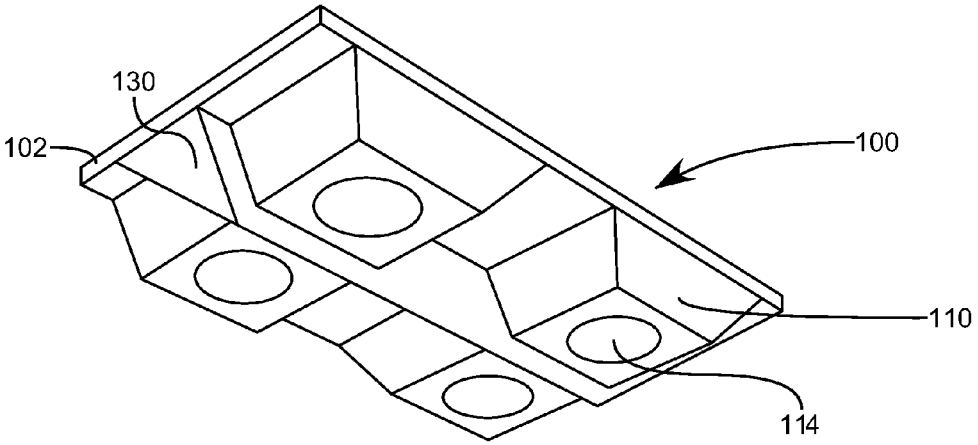
Figure 16C:
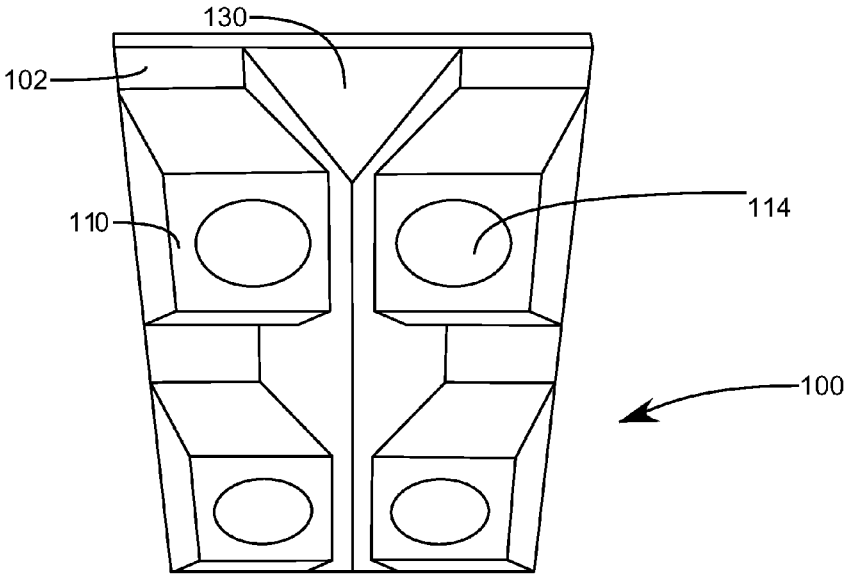

It will be further appreciated that while each of the components have been discussed separately above, FIGS. 16A-C illustrate how the various components can all be formed unitarily, for purposes of illustration the first fastening component 100 is shown here. In this manner a base portion 102, the mechanical interference components 110, and guide channel 130, wherein the magnetic components 110 can be embedded into recesses provided therein. At this point the base portion can be affixed to a strap of a glove or virtually any other desired fastening point. It will then be further appreciated that similar construction techniques can also be applied to the second fastener component 200 (not shown).

In this manner the various embodiments are able to satisfy the ease of use requirement and still manage to be sufficiently engaged. The coupling system can also be configured to provide engagement of the components through a range of relative locations rather than in a precisely located orientation and/or location. The system can also be configured to provide a certain degree of relative float and flexibility while coupling is still maintained. Additionally the present design allows for some amount of self-correcting rotation on the (Y axis) as well as positional ranges in all directions on the plane established by the receiver channel, i.e. translation along the X and Z axes.

It will be appreciated that magnets can be provided in either the first or second component and matched against a ferromagnetic plate in the opposing component, or alternatively magnets can be provided in both the first and second component. It will also be appreciated that the location of the guide channel and center guide can also be reversed in their respective locations on the first and second components.

It will also be appreciated that the guide channel and center guide can be provided as either magnetically reactive or magnetic components such that they contact each other directly upon engagement.

While several embodiments have been described herein that are exemplary of the present invention, one skilled in the art will recognize additional embodiments within the spirit and scope of the invention. Modification and variation can be made to the disclosed embodiments without departing from the scope of the disclosure. Those skilled in the art will appreciate that the applications of the embodiments disclosed herein are varied. Accordingly, additions and modifications can be made without departing from the principles of the disclosure. In this regard, it is intended that such changes would still fall within the scope of the disclosure. Therefore, this disclosure is not limited to particular embodiments, but is intended to cover modifications within the spirit and scope of the disclosure. It will be further appreciated that any of the features discussed above with regard to any particular embodiments can be applied to any alternative embodiments with minor modifications where applicable as will be appreciated by those having skill in the art.

What is claimed is:

1. Hybrid Mechanical and Magnetic Fastening System, the system comprising:

a plurality of first fastener components, each first fastener component having one or more primary mechanical features, the one or more primary mechanical features having a primary interference surface, the first fastener component also having a first magnetic component;

a plurality of second fastener components, each second fastener component having one or more secondary mechanical features, the one or more secondary mechanical features having a secondary interference surface coinciding in shape with the primary interference surface of the first fastener component so as to be interferingly engageable, the second fastener component having a second magnetic component;

a primary contact plane being defined as a primary plane between the first and second fastener;

wherein each primary interference surface and each secondary interference surface are angled with respect to the primary contact plane;

wherein the first and second magnetic components are configured to attract to one another and cause engagement of the primary and secondary interference surfaces; and wherein the plurality of primary mechanical features and the plurality of secondary mechanical features when in an engaged state maintain a predetermined float distance between opposing primary surfaces of the primary mechanical features and opposing secondary surfaces of the secondary mechanical features.

2. The system of claim 1, further comprising:

an alignment guide provided on one of the first or second fastener components; and a guide channel provided on the other of the opposing first or second fastener components the guide channel being configured to receive the alignment guide.

3. The system of claim 2, wherein the first and second magnetic components are provided as the guide channel and the alignment guide.

4. The system of claim 1, wherein the mechanical features of both the first and second fastener components are provided having a multi-axial trapezoidal shape being trapezoidal in shape in respective planes being parallel to the first and second engagement surfaces.

5. The system of claim 1, wherein the first magnetic component is embedded above the one or more mechanical features of the first fastener component.

6. The system of claim 1, wherein the second magnetic component is embedded below the one or more mechanical features of the second fastener component.

7. The system of claim 1, wherein the primary interference surface is formed by an out-of-plane ramped surface with respect to the primary contact plane.

8. The system of claim 7, wherein the primary and secondary interference surfaces are formed into a plurality of corresponding and interfering concave hooks.

9. The system of claim 1, wherein the primary interference surface is formed as an orthogonal surface with respect to the primary contact plane.

10. The system of claim 1, further comprising a plurality of primary mechanical features and a plurality of secondary mechanical features each being spaced at respective corresponding intervals about the first and second fastener components.

11. The system of claim 1, further comprising a release tab formed about the first or second fastener components configured to receive a tensile force and thus release engagement between the first and second fastener component.

12. A Hybrid Mechanical and Magnetic Fastening System, the system comprising:

a strap portion;

a first fastener component having one or more primary mechanical features, the one or more primary mechanical features having a primary interference surface, the first fastener component also having a first magnetic component, the first fastener component being located about a distal end of the strap portion;

a second fastener component having one or more secondary mechanical features, the one or more secondary mechanical features having a secondary interference surface coinciding in shape with the primary interference surface of the first fastener component so as to be interferingly engageable, the second fastener component having a second magnetic component, the second fastener component being located about an anchor point and being configured to receive the distal end of the strap portion;

a primary contact plane being defined as a primary plane between the first and second fastener;

wherein each primary interference surface and each second interference surface are angled with respect to the primary contact plane;

wherein the plurality of primary mechanical features and the plurality of secondary mechanical features when in an engaged state maintain a predetermined float distance between opposing primary surfaces of the primary mechanical features and opposing secondary surfaces of the secondary mechanical features;

an alignments guide provided on one of the first or second fastener components;

a guide channel provided on the other of the first or second fastener components opposing and configured to receive the alignment guide; and wherein the first and second magnetic components are configured to attract to one another and cause engagement of the primary and secondary interference surfaces.

13. The system of claim 12, wherein the first and second magnetic components are provided as the guide channel and the alignment guide.

14. The system of claim 12, wherein the mechanical features of both the first and second fastener components are provided having a multi-axial trapezoidal shape being trapezoidal in shape in respective planes being parallel to the first and second engagement surfaces.

15. The system of claim 12, wherein the first magnetic component is embedded above the one or more mechanical features of the first fastener component.

16. The system of claim 12, wherein the second magnetic component is embedded below the one or more mechanical features of the second fastener component.

17. The system of claim 12, wherein the primary interference surface is formed by an out-of-plane ramped surface with respect to the primary contact plane.

18. The system of claim 17, wherein the primary and secondary interference surfaces are formed into a plurality of corresponding and interfering concave hooks.

19. The system of claim 12, further comprising a plurality of primary and secondary mechanical features, the plurality of primary and secondary mechanical features being spaced at respective corresponding intervals about the first and second fastener components.

20. A Hybrid Mechanical and Magnetic Fastening System, the system comprising:

a strap portion;

a first fastener component having one or more primary mechanical features, the one or more primary mechanical features having a primary interference surface, the first fastener component also having a first magnetic component, the first fastener component being located about a distal end of the strap portion;

a second fastener component having one or more secondary mechanical features, the one or more secondary mechanical features having a secondary interference surface coinciding in shape with the primary interference surface of the first fastener component so as to be interferingly engageable, the second fastener component having a second magnetic component, the second fastener component being located about an anchor point and being configured to receive the distal end of the strap portion;

a primary contact plane being defined as a primary plane between the first and second fastener;

an alignment guide provided on one of the first or second fastener components;

a guide channel provided on the other of the first or second fastener components opposing and configured to receive the alignment guide;

wherein the first and second magnetic components are configured to attract to one another and cause engagement of the primary and secondary interference surfaces;

wherein the mechanical features of both the first and second fastener components are provided having a multi-axial trapezoidal shape being trapezoidal in shape in respective planes being parallel to the first and second engagement surfaces; and wherein the primary interference surface is formed by an out-of-plane ramped surface with respect to the primary contact plane;

wherein the plurality of primary mechanical features and the plurality of secondary mechanical features when in an engaged state maintain a predetermined float distance between opposing primary surfaces of the primary mechanical features and opposing secondary surfaces of the secondary mechanical features.

* * * * *